US008358072B2

(12) United States Patent
Mudra

(10) Patent No.: US 8,358,072 B2
(45) Date of Patent: Jan. 22, 2013

(54) CIRCUIT ARRANGEMENT, AND METHOD FOR THE OPERATION OF A FLUORESCENT LAMP

(75) Inventor: Thomas Mudra, Kastl (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 468 days.

(21) Appl. No.: 12/598,201

(22) PCT Filed: May 4, 2007

(86) PCT No.: PCT/EP2007/054344

§ 371 (c)(1),
(2), (4) Date: Oct. 30, 2009

(87) PCT Pub. No.: WO2008/135086

PCT Pub. Date: Nov. 13, 2008

(65) Prior Publication Data

US 2010/0134012 A1 Jun. 3, 2010

(51) Int. Cl.
*H01J 13/46* (2006.01)

(52) U.S. Cl. ..... 315/48; 315/107; 315/94; 315/46; 315/112

(58) Field of Classification Search ..... 315/46–49, 315/64–69, 94–107
See application file for complete search history.

(56) References Cited

U.S. PATENT DOCUMENTS 7,268,496 B2 * 9/2007 Takahashi et al. ..... 315/105
7,339,322 B2 * 3/2008 Waymouth et al. ..... 315/107

FOREIGN PATENT DOCUMENTS

DE 102005017674 A1 10/2006
EP 1672963 A2 6/2006
GB 2326473 A 12/1998
WO 9711586 A1 3/1997

OTHER PUBLICATIONS

International Search Report of PCT/EP2007/054344 mailed on Feb. 6, 2008.
English language abstract for DE 10 2005 017 674 A1.

* cited by examiner

*Primary Examiner* — Tuyet Thi Vo

(57) ABSTRACT

A circuit arrangement is provided for operating a fluorescent lamp with a first and a second filament, the circuit arrangement including a heater for the first and the second filament, wherein the circuit arrangement furthermore includes: an apparatus for storing at least one threshold value for at least one operational parameter of the fluorescent lamp; an apparatus for determining the value of the at least one operational parameter; and a control apparatus, which is configured to activate the heater for the first and the second filament for a predeterminable period of time in the event of the at least one threshold value for the at least one operational parameter being exceeded by the determined value of the at least one operational parameter.

11 Claims, 1 Drawing Sheet

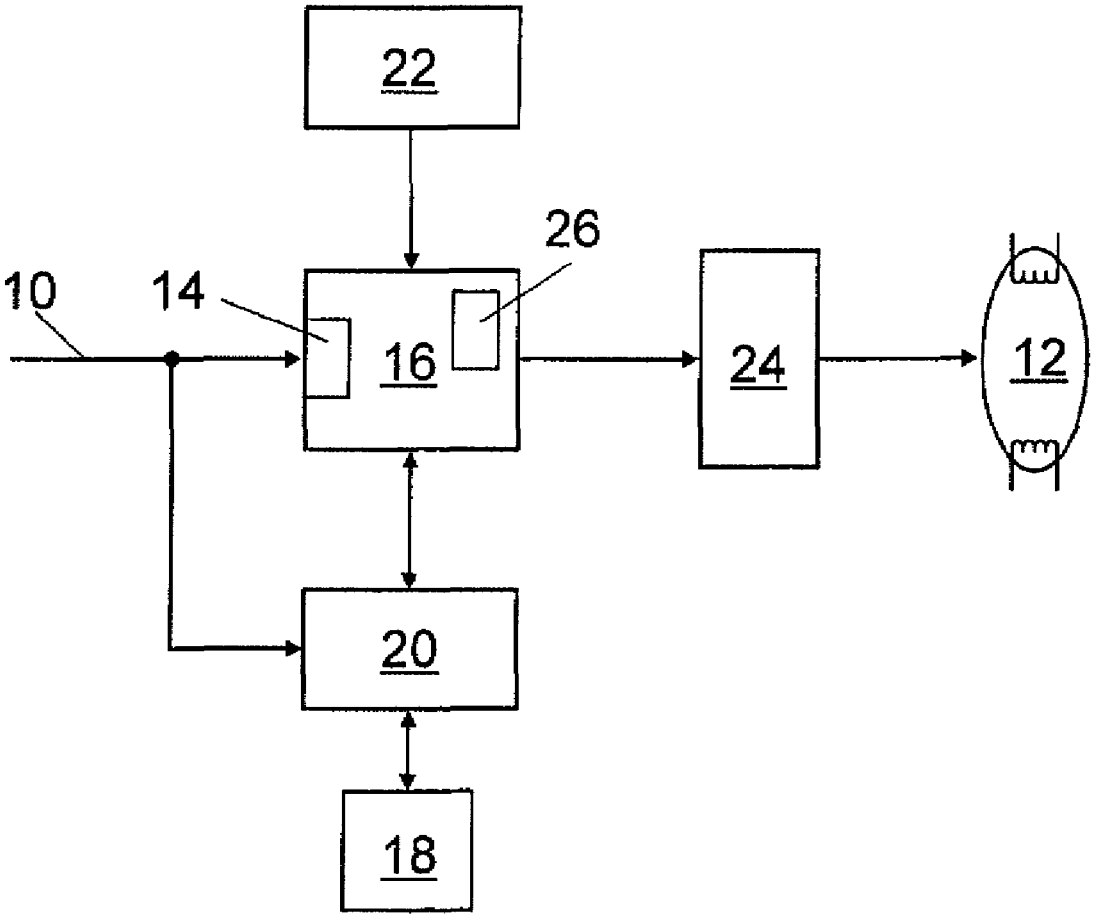
22
26
10
14
16
24
12
20
18

CIRCUIT ARRANGEMENT, AND METHOD FOR THE OPERATION OF A FLUORESCENT LAMP

RELATED APPLICATIONS

The present application is a national stage entry according to 35 U.S.C. §371 of PCT application No.: PCT/EP2007/054344 filed on May 4, 2007.

TECHNICAL FIELD

The present invention relates to a circuit arrangement for operating a fluorescent lamp with a first and a second filament, the circuit arrangement including a heater for the first and the second filament. The invention moreover relates to a method for operating a fluorescent lamp with a first and a second filament using a circuit arrangement with a heater for the first and the second filament.

BACKGROUND

During operation of fluorescent lamps, as a result of various effects, regions on the filaments can form which impair or even entirely prevent the emission capability of the emitter. In particular the deposition of impurities or of eroded material and the resultant conversion processes need to be included in these effects. The mentioned regions are therefore available for the emission to a restricted extent or no longer available at all, as a result of which the maximum possible life of the lamp is not reached.

Permanent filament heating in order to prevent such depositions is undesirable as a result of the permanent losses associated therewith, which result in considerable impairment of the efficiency of the fluorescent lamp, and as a result of the heating of the cold spot for the Hg vapor pressure setting. The heating of the filaments for starting the fluorescent lamp is very short, i.e. this heating operation is less than 0.5 s and is predominantly inhomogeneous. As a result, it is not possible either for deposits to be removed or prevented.

SUMMARY

Various embodiments provide a circuit arrangement as mentioned at the outset and a method as mentioned at the outset in such a way that an extension of the life of fluorescent lamps is made possible.

The present invention is based on the knowledge that the abovementioned object can be achieved in optimum fashion if the filaments are heated at periodic intervals in order thus to avoid deposits and the resultant life-shortening effects. In this case, the periodicity can be linked to different operational parameters of the fluorescent lamp, as is specified in more detail further below. As a result, it is possible to achieve a very long life of fluorescent lamps, and this with a virtually irrelevant impairment of the efficiency.

A circuit arrangement according to the invention accordingly furthermore includes an apparatus for storing at least one threshold value for at least one operational parameter of the fluorescent lamp, an apparatus for determining the value of the at least one operational parameter, and a control apparatus, which is configured to activate the heater for the first and the second filament for a predeterminable period of time in the event of the at least one threshold value for the at least one operational parameter being exceeded by the determined value of the at least one operational parameter.

The at least one operational parameter may be, for example, the operating duration of the fluorescent lamp. In a preferred embodiment, the ratio of the operating duration to heating duration is 100 to 1, for example.

The at least one operational parameter can furthermore be the number of switch-on/switch-off operations of the fluorescent lamp. In preferred embodiments, this number is between 1 and 10.

The at least one operational parameter may, however, also be the number of dimming changes of the fluorescent lamp. In this case, too, the number is between 1 and 10 in preferred embodiments.

Provision may be made for a plurality of operational parameters to be monitored and for the filament heater to be activated when a predeterminable number of operational parameters, preferably one of the operational parameters, has exceeded its predeterminable threshold value.

The predeterminable period of time is preferably at least 2 seconds, in particular 1 minute.

In a preferred embodiment, the control apparatus has an interface, which is configured to receive switch-on and switch-off signals for the fluorescent lamp, the control apparatus being configured to activate the heater of the first and the second filament if, firstly, the at least one threshold value of the at least one operational parameter has been exceeded and, secondly, a switch-off signal has been received via the interface. This makes it possible in particular to use a circuit apparatus according to the invention in fluorescent lamps in which the filaments should not be heated in a range of dimming settings above 80% of the maximum dimming setting in order furthermore to achieve the optimum lamp operation conditions (so-called cut-off operation). It is preferred in this context if the control apparatus is furthermore configured to set the fluorescent lamp to a predeterminable state during the predeterminable period of time. This predeterminable state can in particular correspond to the disconnection of the fluorescent lamp or to a predeterminable dimming setting, in this case the minimum dimming setting being preferred.

Further advantageous embodiments are given in the dependent claims.

The preferred embodiments proposed with reference to the circuit arrangement according to the invention and the advantages thereof apply, if appropriate, correspondingly to the method according to the invention.

BRIEF DESCRIPTION OF THE DRAWING(S)

An exemplary embodiment will now be illustrated in more detail below with reference to the attached drawing. Said drawing shows a schematic illustration of an exemplary embodiment of a circuit arrangement according to the invention.

DETAILED DESCRIPTION

The following detailed description refers to the accompanying drawings that show, by way of illustration, specific details and embodiments in which the invention may be practiced.

FIG. 1 shows a schematic illustration of an exemplary embodiment of a circuit arrangement according to the invention. It includes a control line 10, via which switch-on and switch-off signals and/or dimming signals for a fluorescent lamp 12 are transmitted, for example. These signals are supplied to an interface 14 of a control apparatus 16, where they are converted into drive signals for operating the fluorescent lamp 12. However, they are also supplied to an apparatus 20 for determining at least one value of an operational parameter, the apparatus 20 being capable of being coupled to a timer 18 in order to detect the operating hours of the fluorescent lamp 12.

In addition or as an alternative, the apparatus 20 for determining an operational parameter can be configured to count the number of switch-on/switch-off operations and/or the number of dimming changes, in particular relevant dimming changes.

The apparatus 20 for determining at least one operational parameter supplies the value of the at least one operational parameter to the control apparatus 16. At least one threshold value of at least one corresponding operational parameter of the fluorescent lamp 12 is stored in a memory apparatus 22. The control apparatus 16 now checks whether at least one of the values transmitted from the apparatus 20 for determining the value of at least one operational parameter to the control apparatus 16 exceeds the corresponding threshold value stored in the memory apparatus 22. If this is the case, the control apparatus 16, after reception of the next switch-off signal at the interface 14, activates a filament heater 24. In this case, the fluorescent lamp 12 may already be in the switched-off state or in state of a predeterminable dimming setting, for example in the minimum dimming setting. The filament heater 24 is activated over a predeterminable period of time, with the control apparatus 16 including a timer 26 for this purpose.

It is readily possible to integrate the elements 14, 16, 18, 20, 22, 26 in one unit, in which case only one timer needs to be provided, with this timer then performing the function of the timer 18 and the timer 26. A circuit arrangement according to the invention can be realized, for example, in an electronic ballast, in which, after a predeterminable number of operating minutes and/or after a predeterminable number of switch-on/switch-off operations and/or dimming changes, the filament heater 24 is activated over the predeterminable period of time.

Said circuit arrangement can also be realized in a DALI control device, in which case it is preferred to operate the filament heater 24 in the standby mode, i.e. with the fluorescent lamp switched off, or after the "light off" command when the fluorescent lamp 12 is switched on in a predeterminable dimming setting, in particular in the minimum dimming setting.

A circuit arrangement according to the invention can also be realized in a control device for dimming devices, in which, after reception of a disconnection request, the fluorescent lamp 12 is operated over a predeterminable period of time prior to the actual disconnection in a predeterminable dimming setting, in particular in a minimum dimming setting.

With reference to the dimming changes mentioned in the preceding text, a threshold can be provided in order to detect only a significant dimming change as an event which results in a counting operation in the apparatus 20. A significant dimming change can be defined, for example, by a dimming change of more than 30% of the total possible dimming range.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

Additionally, please cancel the originally-filed Abstract of the Disclosure, and add the accompanying new Abstract of the Disclosure which appears on a separate sheet in the Appendix.

The invention claimed is:

1. A circuit arrangement for operating a fluorescent lamp with a first and a second filament, the circuit arrangement comprising a heater for the first and the second filament, wherein the circuit arrangement furthermore comprises:

an apparatus for storing at least one threshold value for at least one operational parameter of the fluorescent lamp;

an apparatus for determining the value of the at least one operational parameter; and a control apparatus, which is configured to activate the heater for the first and the second filament for a predeterminable period of time in the event of the at least one threshold value for the at least one operational parameter being exceeded by the determined value of the at least one operational parameter.

2. The circuit arrangement as claimed in claim 1, wherein the at least one operational parameter is the operating duration of the fluorescent lamp.

3. The circuit arrangement as claimed in claim 1, wherein the at least one operational parameter is the number of switch-on/switch-off operations of the fluorescent lamp.

4. The circuit arrangement as claimed in claim 1, wherein the at least one operational parameter is the number of dimming changes of the fluorescent lamp.

5. The circuit arrangement as claimed in claim 1, wherein the predeterminable period of time is at least 2 seconds.

6. The circuit arrangement as claimed in claim 5, wherein the predeterminable period of time is at least 1 minute.

7. The circuit arrangement as claimed in claim 1, wherein the control apparatus has an interface, which is configured to receive switch-on and switch-off signals for the fluorescent lamp, the control apparatus being configured to activate the heater of the first and the second filament if, firstly, the at least one threshold value of the at least one operational parameter has been exceeded and, secondly, a switch-off signal has been received via the interface.

8. The circuit arrangement as claimed in claim 7, wherein the control apparatus is furthermore configured to set the fluorescent lamp to a predeterminable state during the predeterminable period of time.

9. The circuit arrangement as claimed in claim 8, wherein the predeterminable state corresponds to at least one of the disconnection of the fluorescent lamp and a predeterminable dimming setting.

10. The circuit arrangement as claimed in claim 9, wherein the predeterminable state corresponds to the predeterminable dimming setting, namely the minimum dimming setting.

11. A method for operating a fluorescent lamp with a first and a second filament using a circuit arrangement with a heater for the first and the second filament, comprising:

a) fixing at least one threshold value for at least one operational parameter of the fluorescent lamp; and b) in the event of the at least one threshold value being exceeded: activation of the heater for the first and the second filaments for a predeterminable period of time.

* * * * *